US005236281A

United States Patent [19]

Middleton

[11] Patent Number: 5,236,281

[45] Date of Patent: Aug. 17, 1993

[54] DIKES FOR DAMMING OR DIVERTING LIQUIDS

[75] Inventor: Dennis G. Middleton, Tyrone, Pa.

[73] Assignee: New Pig Corporation, Tipton, Pa.

[21] Appl. No.: 914,713

[22] Filed: Jul. 15, 1992

[51] Int. Cl.[5] ..... E02B 7/00

[52] U.S. Cl. ..... 405/114; 404/6; 404/14; 404/15; 405/91; 405/115

[58] Field of Search ..... 405/114, 52, 115, 107, 405/91; 404/38, 25, 6, 15, 14; 52/102

[56] References Cited

U.S. PATENT DOCUMENTS

| | | | |
|---|---|---|---|
| 1,742,369 | 1/1930 | Probst et al. | 405/114 |
| 4,031,676 | 6/1977 | Dally | 405/114 X |
| 4,765,775 | 8/1988 | Kroger | 405/52 |
| 4,799,821 | 1/1989 | Brodersen | 405/52 X |
| 4,813,811 | 3/1989 | Adams | 404/38 X |
| 4,981,391 | 1/1991 | Klementovich | 405/52 |
| 4,988,234 | 1/1991 | Henkel et al. | 405/52 X |

*Primary Examiner*—Dennis L. Taylor

*Attorney, Agent, or Firm*—Webb, Burden, Ziesenheim & Webb

[57] ABSTRACT

A device for damming and diverting liquid on a spill surface has an elongated, pliable dike having a first end, a second end and an exposed surface. The exposed surface is inherently tacky so that it is adherable to the spill surface to prevent flow of liquid past the dike. The dike is preferably triangular and made from a substance, such as polyurethane, so that all exposed surfaces on the dike are inherently tacky, including those created when a portion of the dike is severed to tailor the dike for specific damming needs. The device also includes a joint housing which may be engaged on abutting ends of adjacent dikes to seal the joint. A method for creating a liquid control zone on a spill surface utilizing the dike of the present invention is also disclosed.

19 Claims, 1 Drawing Sheet

DIKES FOR DAMMING OR DIVERTING LIQUIDS

BACKGROUND OF THE INVENTION

1. Field of the Invention

This invention is related to devices for controlling fluid flow and, more particularly, to portable dikes for damming and diverting liquids.

2. Description of the Prior Art

Removable liquid blocking devices for use on surfaces, such as building floors, are well-known in the art. See, for example, U.S. Pat. Nos. 4,031,676; 4,981,391 and 5,059,065. However, with the advent of strict environmental regulations, there is an increasing need for readily accessible damming devices which can be placed on a spill surface for immediate control of hazardous liquids. Furthermore, it is desired that the devices be readily adaptable to enclose areas of varying shapes and sizes, with minimal effort and expense.

U.S. Pat. No. 4,031,676 discloses a rubber water blocking device having a bottom surface with a plurality of recessed disc portions which define suction cups. The bottom is engaged on smooth surfaces to form a semi-permanent dam structure. The device may be provided in straight sections and curved sections, with the sections interlocked by a tongue and groove arrangement. This device appears unduly expensive to manufacture as any mold which forms the device would have to provide several suction cups on the bottom surface. The device also suffers from reduced adaptability because it is provided in sections of predetermined length which are not easily adapted on site to conform to various sized spill areas.

U.S. Pat. No. 4,981,391 discloses an inflatable, portable dam apparatus having a tubular structure and a bottom sheet of flexible material. Inflation of the dam is unduly time consuming, especially in cases where immediate, on-site liquid control is the desired object.

Similarly, U.S. Pat. No. 5,059,065 discloses a fluid-filled damming structure having a coupling sleeve arrangement for innerconnecting and receiving adjacent ends of the damming structures.

U.S. Pat. No. 3,847,722 discloses a permeable, laminated web impregnated with a urethane prepolymer to stop water leaks in small holes or crevices. The prepolymer reacts with water to form a swollen, adherent hydrogel. However, the web does not have substantial thickness, so it cannot be placed on a level spill surface for controlling or containing liquids. A permeable filler material, such as wood chips, may be placed inside the web, but this is impractical for on-site spill control.

Therefore, it is an object of the present invention to provide a device for damming and diverting liquids on spill surfaces, such as building floors. It is a further object to provide a pliable device which may be easily conformed and tailored to meet a variety of damming configurations. It is a still further object to provide a device which is readily adherent to the spill surface. Finally, it is an object to provide a device which comports with the above objectives, but which may be quickly employed on site for emergency spill control, and further which is inexpensive and simple to manufacture.

SUMMARY OF THE INVENTION

Therefore, I have invented a device for damming and diverting liquids on a spill surface having an elongated, pliable dike with a first end, a second end and a tacky exposed surface. The exposed surface is adherable to a spill surface to prevent flow of liquid past the dike.

Preferably, the body is of angular, solid construction and includes a plurality of exposed surfaces which are inherently tacky. The body may have a triangular cross section, with two edges adjacent the exposed surface being chamfered. The exposed surface is preferably smooth.

The device also includes a joint housing whose internal dimensions conform to the external dimensions of the dike and which may receive both ends of the dike. Each end of the dike may have a tacky abutment surface, so that when adjacent ends of successive dikes are engaged, they will adhere to one another to form a joint. The joint housing may then be overlapped on the joint to seal the joint.

The invention also includes a method for creating a liquid control zone on a spill surface, utilizing the dike described above. The method may include severing a portion of the dike to form specific liquid control areas.

The invention may be utilized both to contain liquid and to divert liquid flow. The dike is readily pliable to conform to various damming configurations. Portions of the dike may be severed on site by the user, without special tools, to tailor the dike for specific damming needs. All exposed surfaces on the dike are preferably inherently tacky so that a one-step manufacturing process provides both the desired damming structure and the adherence necessary to secure the dike on a spill surface and create a proper seal.

Further details and advantages of the invention will become apparent from the following description in conjunction with accompanying drawings.

BRIEF DESCRIPTION OF THE DRAWINGS

FIG. 5 is a perspective view of a device for damming and diverting liquids according to the present invention in place on a spill surface and damming liquid around a spill hazard, i.e., a drum of oil or the like.

DETAILED DESCRIPTION OF THE PREFERRED EMBODIMENT

Figure 1:
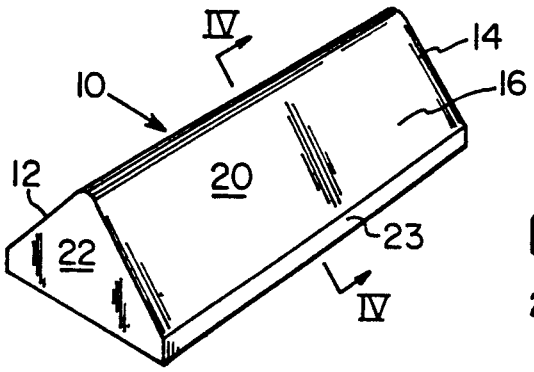
FIG. 1 is a perspective view of a dike in accordance with the present invention.
Figure 4:
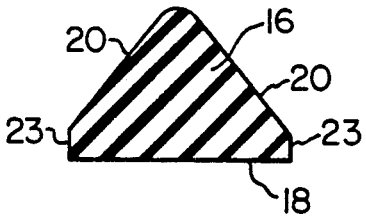
FIG. 4 is a cross section taken along lines 4—4 of FIG. 1.

FIGS. 1 and 4 show a dike 10 having a first end 12, a second end 14 and a pliable body 16, according to the present invention. Body 16 has a triangular cross section and is of solid construction. The dike is made from a soft, yet resilient material, such as polyurethane.

The dike 10 has a bottom surface 18 with two upper surfaces 20. Bottom surface 18 is substantially smooth, with variances in the degree of smoothness due to factors in the manufacturing process, described below. Each end 12, 14 of the dike 10 has an upwardly directed abutment surface 22. Edges 23 adjacent bottom surface 18 are chamfered. Particularly, the edges may be beveled, tapered or indented with a semi-circular groove.

The dike 10 may take many shapes, but preferably it is angular, such as an oblique triangle, an obtuse triangle, a square, a rectangle or an acute triangle. The dike described herein is an isosceles triangle. In any case, all exposed surfaces on the dike 10 are inherently tacky as discussed below.

Figure 2:
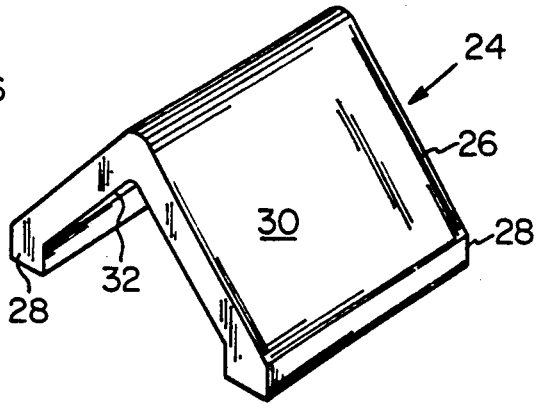
FIG. 2 is a perspective view of a joint housing in accordance with the present invention.
Figure 3:
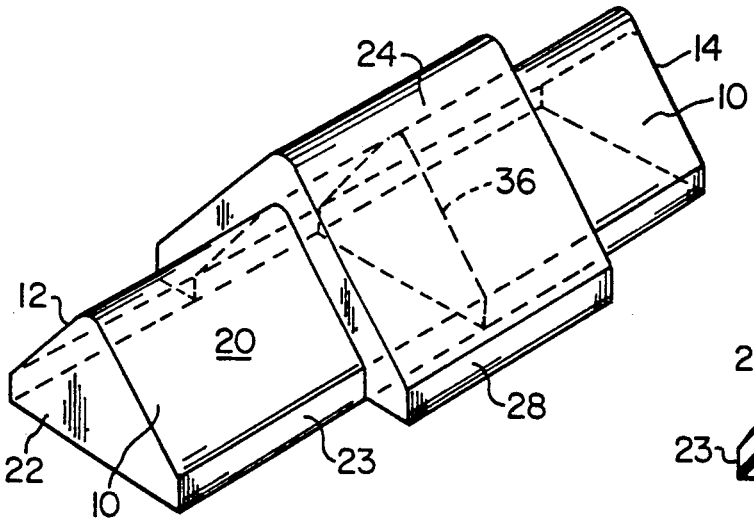
FIG. 3 is a perspective view of the joint housing of FIG. 2 engaged on a joint created by abutting ends of two dikes.

Referring to FIGS. 2-3, a joint housing 24 has an upper arch 26 with two legs 28. The joint housing has an outer surface 30 and an inner surface 32, and the internal dimensions of the joint housing correspond to the external dimensions on dike 10. The joint housing 24 is comparatively short in length with respect to the dike 10 and is open ended so it may receive both the first end 12 and second end 14 of dike 10, or the abutted ends of adjacent dikes 10.

The dike 10 and the joint housing 24 are both made from polyurethane as provided by P.S.I. Urethanes of San Antonio, Tex. Particularly, a mixture of various polyurethanes is poured into a mold and allowed to cure. The liquid is mixed and cured in a manner which gives a moderate degree of inherent tackiness to all exposed surfaces of the dike. The molding and curing process creates a substantially smooth bottom surface 18, which may contain minor undulations. As mentioned above, the polyurethane dike is soft, yet resilient, and thus may be easily severed by a user with a knife. Surfaces on the dike which are exposed when a portion of the dike is severed are also inherently tacky.

In use, the dike 10 is shipped and stored in coiled, ten-foot sections and packed in a wax-lined box. The coils are separated by cardboard sheets to preserve the tackiness on outer surfaces 18, 20 and 22. Alternatively, each dike 10 could be 100% covered by a one (1) mil., polyurethane film. In both cases, the sheath preserves tackiness and promotes ease of handling.

Figure 5:
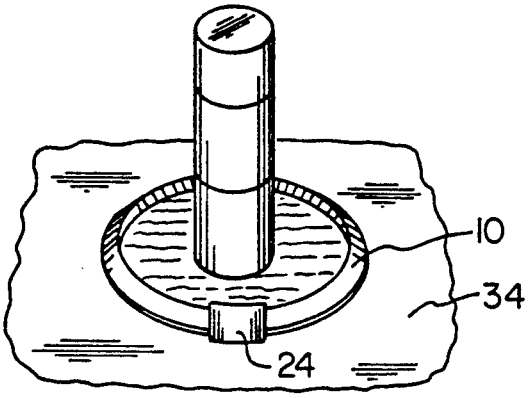

Referring to FIG. 5, the dike 10 may be used for controlling spills on surfaces, such as building floor 34. The user first determines the boundary for the desired liquid control zone. The zone may be a closed area, or it may be open ended to simply divert liquid flow into a desired flow path. The user then removes a sufficient number of coils from the wax-lined box to cover the predetermined boundary. Any sheath remaining on bottom surface 18 is removed, and the bottom surface is adhered to the spill surface along the predetermined boundary. The adherence of the dike 10, coupled with its resilient pliability, creates a seal on the surface which is sufficient to prevent flow of liquid past the dike 10. Additionally, the dike 10 will conform to any irregularities in the spill surface 34.

The above steps are repeated with successive dikes, or "extension dikes" until the desired boundary is defined. In this regard, dikes 10 are joined by abutting the first end 12 of an extension dike to the second end 14 of the dike previously placed on the spill surface to form a joint 36, as shown in FIG. 3. As stated, each end of the dikes has a tacky abutment surface 22 which holds the dikes together at joint 36.

A joint housing 24 may then be placed on top of the abutting ends to cover the joint, if a more secure joint is desired. The inner surface 32 of the joint housing 24 adheres to the upper surfaces 20 of the dikes 10 to insure stability and to maintain the joint housing securely in place. The legs 28 on the joint housing 24 further prevent incursion of liquids through the joint. The chamfered edges 23 on the dike 10 receive the legs 28 to enhance sealing.

In certain cases, a portion of one or more of the dikes 10 must be severed in order to tailor the dike to the particular flow boundary desired. This may be done with a knife on site by a user. The severed surface is also tacky and may be abutted on the end 12, 14 of an adjacent dike.

The isosceles triangle dike 10 has been found particularly suitable as the wider bottom surface 18 provides greater stability when adhered to the spill surface 34 and can better compensate for irregularities in the spill surface. Alternatively, the top surface 20 of the dike 10 may be adhered to the spill surface. It is anticipated that this could be especially useful when the dike is to form curbing, such as for blocking doorways contiguous with a floor to be mopped or waxed.

Further advantages are derived from use of the dike 10 to dam or divert liquids as follows:

1. The dike 10 and the joint housing 24 may be quickly employed for emergency, on-site spill control with minimal effort;
2. The dike and the joint housing are made from safe materials which are resistive to breakdown by most harmful commercial chemicals;
3. The dikes are reusable;
4. The dikes are easily severable to tailor the dikes to specific needs;
5. The dikes allow the user to dam liquid for subsequent removal by vacuum or pumping;
6. The dikes can be used to divert liquid toward a drain;
7. The dikes can be put in place for preventive spill control; and
8. The dikes are simple to manufacture.

Having described the presently preferred embodiment of the invention, it will be understood that it is not intended to limit the invention except within the scope of the following claims.

I claim:

1. A device for damming and diverting liquid on a spill surface, comprising:

an elongated, pliable dike made from an inherently tacky, resilient material and having a first end, a second end and an exposed surface;

said exposed surface being inherently tacky so that it may be adhered to said spill surface to prevent flow of liquid past said dike.

2. The device of claim 1 wherein said dike has an angular cross section.

3. The device of claim 2 wherein said dike is triangular.

4. The device of claim 3 including at least three edges, with two edges adjacent said exposed surface being chamfered.

5. The device of claim 1 wherein said exposed surface is substantially smooth.

6. The device of claim 1 wherein said dike is of solid construction.

7. The device of claim 1 including a joint housing whose internal dimensions conform to the external dimensions of said dike and of a size to receive abutted ends of said dike or dikes.

8. The device of claim 1 including a tacky abutment surface on each end of said dike.

9. A device for damming and diverting liquid on a spill surface, comprising:

an elongated, solid, pliable dike made from an inherently tacky, resilient material and having a first end, a second end and at least one exposed surface which is inherently tacky;

said exposed surface adherable to said spill surface to prevent flow of liquid past said dike.

10. The device of claim 9 wherein said dike has an angular cross section.

11. The device of claim 9 wherein said exposed surface is substantially smooth.

12. The device of claim 9 including a tacky abutment surface on each end of said dike.

13. The device of claim 9 including a joint housing whose internal dimensions conform to the external dimensions of said dike and which may receive abutting ends of said dike or dikes.

14. A method for creating a liquid control zone on a spill surface, comprising the steps of:

(a) providing at least one dike having a first end, a second end and an elongated, pliable body, made from an inherently tacky, resilient material with an exposed surface which is inherently tacky;

(b) determining a flow boundary for said liquid control zone;

(c) adhering said exposed surface to said spill surface along said boundary to create a seal;

(d) repeating steps (a)–(c) until said flow boundary is defined by one or more of said dikes.

15. The method of claim 15 including the step of providing an inherently tacky abutment surface on each end of the dike in step (a).

16. The method of claim 15 including the step of abutting the first end of an extension dike to the second end of the dike of step (a) to form a joint.

17. The method of claim 16 including the steps of providing a joint housing whose internal dimensions conform to the outer dimensions of said dikes and engaging the joint housing on said joint so that it overlaps on both the second and first ends of said dike and extension dike, respectively, to seal said joint.

18. The method of claim 14 wherein step (a) includes providing a dike having a solid body of angular cross section, said dike having a plurality of exposed surfaces which are inherently tacky.

19. The method of claim 14 including the step of severing a portion from at least one dike to conform the dike to said flow boundary.

* * * * *

UNITED STATES PATENT AND TRADEMARK OFFICE

CERTIFICATE OF CORRECTION

PATENT NO. : 5,236,281

DATED : August 17, 1993

INVENTOR(S) : Dennis G. Middleton

It is certified that error appears in the above-identified patent and that said Letters Patent is hereby corrected as shown below:

Claim 15 Line 3 Column 6 "15" should read --14--.

Signed and Sealed this

Fifteenth Day of March, 1994

*Attest:*

Bruce Lehman

BRUCE LEHMAN

*Attesting Officer*

*Commissioner of Patents and Trademarks*